United States Patent [19]

Stowe

[11] 4,441,986

[45] Apr. 10, 1984

[54] SHALE RETORTING WITH INORGANIC REMOVAL PRIOR TO COMBUSTION

[75] Inventor: Lawrence R. Stowe, Plano, Tex.

[73] Assignee: Mobil Oil Corporation, New York, N.Y.

[21] Appl. No.: 484,795

[22] Filed: Apr. 14, 1983

[51] Int. Cl.[3] ..... C10G 1/00

[52] U.S. Cl. ..... 208/11 R

[58] Field of Search ..... 208/11 R

[56] References Cited

U.S. PATENT DOCUMENTS

| | | | |
|---|---|---|---|
| 2,984,602 | 5/1961 | Nevens et al. | 208/11 R |
| 3,350,280 | 10/1967 | West | 208/11 R |
| 3,703,052 | 11/1972 | Linden | 208/11 R |
| 4,118,309 | 10/1978 | Myers et al. | 208/11 R |
| 4,158,620 | 6/1979 | Beck | 208/11 R |
| 4,176,042 | 11/1979 | Fahlström | 208/11 LE |
| 4,314,899 | 2/1982 | Styring, Jr. | 208/11 R |
| 4,388,179 | 6/1983 | Lewis | 208/11 R |

*Primary Examiner*—Patrick Garvin
*Assistant Examiner*—Lance Johnson
*Attorney, Agent, or Firm*—A. J. McKillop; M. G. Gilman; J. F. Powers, Jr.

[57] ABSTRACT

Energy is conserved and air pollution reduced by crushing retorted shale after subjecting raw shale to retorting conditions.

19 Claims, 1 Drawing Figure

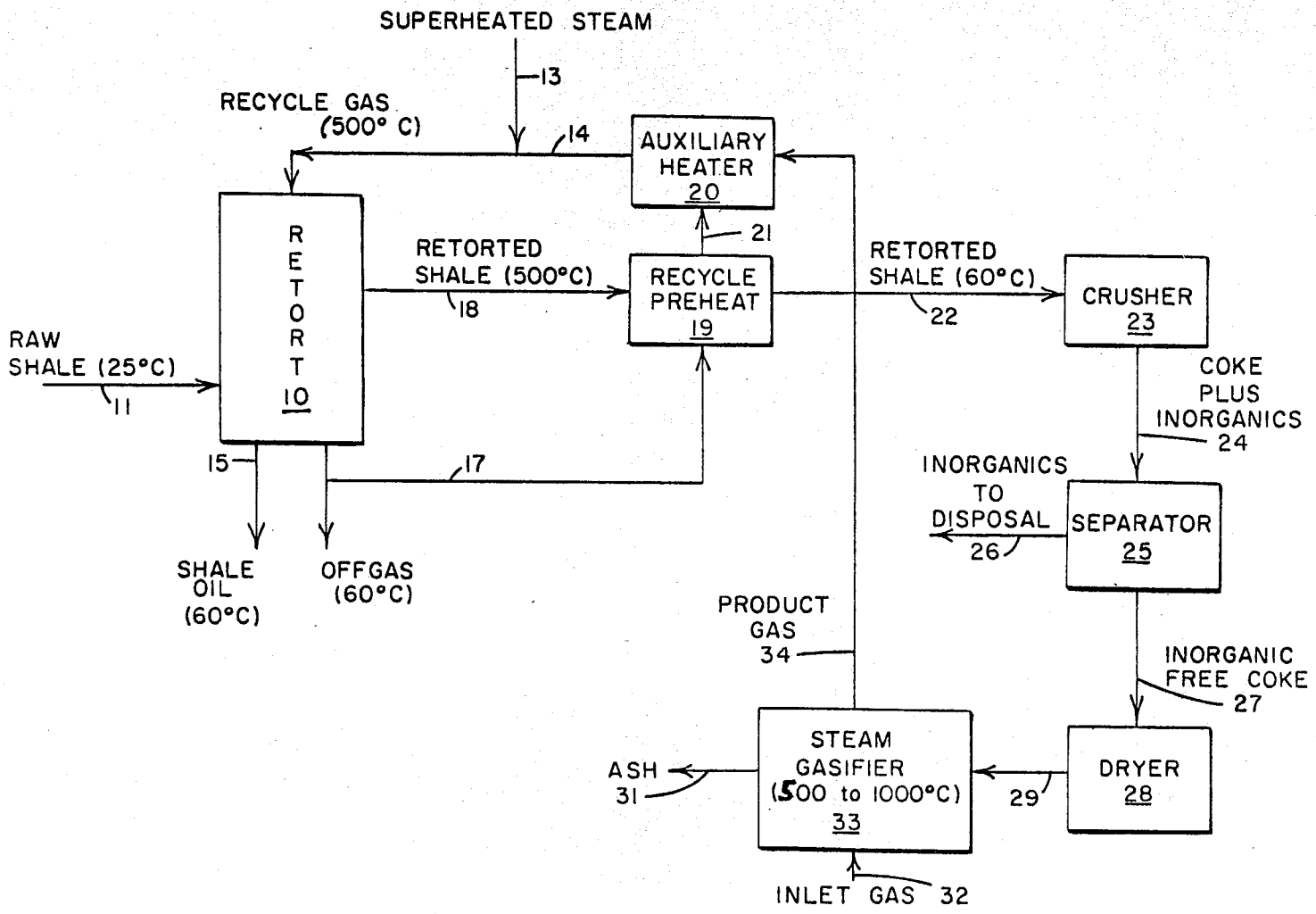
RAW SHALE (25°C)
11
RETORT 10
15
SHALE OIL (60°C)
OFFGAS (60°C)
17
RETORTED SHALE (500°C)
18
RECYCLE GAS (500° C)
SUPERHEATED STEAM
13
14
AUXILIARY HEATER 20
21
RECYCLE PREHEAT 19
RETORTED SHALE (60°C)
22
CRUSHER 23
COKE PLUS INORGANICS 24
SEPARATOR 25
INORGANICS TO DISPOSAL 26
INORGANIC FREE COKE 27
DRYER 28
29
STEAM GASIFIER (500 to 1000°C) 33
INLET GAS 32
PRODUCT GAS 34
ASH 31

SHALE RETORTING WITH INORGANIC REMOVAL PRIOR TO COMBUSTION

BACKGROUND OF THE INVENTION

1. Field of the Invention

The present invention relates to a method of recovering energy from bituminous sedimentary rock, in particular oil shales, in which retorted shale is crushed and then finely divided, to a particle size of sufficient fineness to enable the major portion of the coke and any minerals present to be separated out.

2. Description of the Prior Art

In the prior art, raw shale is crushed and placed into a retort under retorting conditions to obtain hydrocarbon products. After sufficient hydrocarbon products have been obtained, retorted shale may generally be processed to recover heat or synthesis gas. Depending upon the process additional processing of the retorted shale may be necessary since it retains mineral matter and a high energy coke residue. Temperatures required to obtain heat and synthesis gas from the retorted shale are quite high, generally from about 600°-1000° C. At these elevated temperatures mineral decomposition reactions proceed at a rapid speed. Mineral decomposition reactions are endothermic and produce large volumes of carbon dioxide plus other pollutants. Also, thermal efficiency obtained during the retorting stage is lost in the processing of the retorted coke by conventional means.

Those skilled in the prior art have known that surface retorts can be used to recover oil products from oil shale. Allred, U.S. Pat. No. 3,960,702 is an example of the use of a surface retort to recover oil products from oil shale and this patent is hereby incorporated by reference. Brown, U.S. Pat. No. 4,094,769, also used a surface retort to recover oil products from shale. This patent is also hereby incorporated by reference.

In order to retort crushed raw oil shale, it is necessary to use elevated temperatures. Temperatures used in retorting generally are at least as high as 450° C. It is recognized that the residence time should be as short as possible to prevent the coke formation by hydrocarbon vapors released from the retorted oil shale. Since coke formation was not desired, others have sought ways to minimize coke formation and still maintain a high level of hydrocarbon recovery. Coke formation was not desired because to convert it into another form of energy, it was necessary to heat the retorted shale which comprised the inorganic matrix as well as the coke. Heating the coke to a temperature sufficient to transform it to another energy source required even higher temperatures than retorting the raw shale. These temperatures were generally in the range of from about 500° to 1000° C. At these elevated temperatures mineral decomposition of the inorganic matrix occurred which causes the formation of undesired gases which may be classified as environmental pollutants.

In order to avoid the use of high temperatures with attendant mineral decomposition and coking problems, Fahlstrom, U.S. Pat. No. 4,176,042 sought to crush retorted shale into finely divided particles in comminuting stages and subject the particles to physical and chemical separation processes in order to recover the desired oil and inorganic products. This recovery was accomplished by separating the kerogen contained in the raw shale from the inorganic matrix of the rock. After subjecting the raw shale to an initial crushing and comminution stage, separation processes were used. Sequential crushing, comminuting, and separating stages were continued until the desired kerogen inorganic components were obtained.

Until now perhaps an efficient method did not exist for recovering heat values from retorted shale. Allred and Brown taught exposing the uncrushed retorted shale to conventional methods to recover heat values or synthesis gas from the coke entrained on the oil shale. This was done either by the combustion method or by injecting superheated water vapor into a reactor to recover synthesis gas from the retorted shale. Allred taught retorting the shale and disposing of it after cooling. Brown, on the other hand, taught sequentially crushing and then retorting raw shale. No provision was made by Brown for utilizing the retorted shale to recover heat gained during processing. Therefore, neither Allred or Fahlstrom taught a method for the further processing of retorted shale to recover heat values.

In accordance with the present invention it will not be necessary to lower the temperature when retorting oil shale. Thus, hydrocarbon production can be maximized and coking need not be delayed. Increased coking will provide for additional energy which can be used for maintaining the retort temperature. Energy can also be conserved by feeding a larger size of crushed oil shale. Because larger sizes of oil shale can be used in the retort, crushing times for raw oil shale can be reduced. After separating the coke from the inorganic matrix, less heat will be required to convert the coke into other energy forms. Additionally, air pollutants should be minimized since the inorganic matrix will not be subjected to elevated temperatures which led to mineral decomposition.

SUMMARY OF THE INVENTION

This invention discloses a method for the recovery of hydrocarbon products and energy from oil shale which comprises feeding raw shale into a surface retort, retorting the raw shale in the surface retort under oil shale retorting conditions, removing the shale from the retort, recovering sensible heat from the retorted shale, crushing the retorted shale into a particle size sufficient to liberate coke from the inorganic matrix, separating the liberated coke from the inorganic matrix, and heating the liberated coke at a temperature of from about 500° to 1000° C.

An object of the present invention is to provide a method for retaining the thermal efficiency obtained during oil shale retorting by removing the sensible heat, crushing the retorted shale and causing the coke to be separated from its inorganic matrix.

Another object of the present invention is to conserve energy by reducing the amount of heat required to retort raw oil shale.

Still another object is to avoid the mineral decomposition reactions connected with conventional oil shale retorting methods.

A further objective is to provide a method for the disposal of coke ash and the inorganic matrix to minimize adverse impacts upon the environment.

Other objects, advantages and capabilities of the present invention will become more apparent as the description proceeds, when taken in conjunction with the accompanying drawing.

BRIEF DESCRIPTION OF THE DRAWING

The drawing is a schematic drawing which displays the retorting, crushing and recovery process stages of the method.

DESCRIPTION OF THE PREFERRED EMBODIMENTS

Raw shale is fed into a surface retort (10) via line (11). The shale is pulverized or otherwise comminuted to a particle size sufficient for retorting generally in the range of from 0.1 to 2 inches in diameter. The retort (10) will have a temperature sufficient for oil retorting purposes generally within the operating range of from about 425° to 550° C., preferably 500° C. The temperature range may be important in maximizing recovery of heat energy from the organic values and in providing a solid disposable waste. Union B, Tosco 11, and Superior are examples of retorts which can be used in these embodiments and involve only nominal crushing of raw oil shale. Superheated water vapor (13) is injected into the retort via line (14) after being heated to a temperature of about 500° C. The pressure maintained in the retort during contact between the superheated water vapor and the oil shale is generally in the range of from about 1 to about 150 psig. Superficial gas velocities are generally in the range of from about 20 to 1000 feet per minute. Contact time between the oil shale and the superheated water vapor can vary widely and will preferably be in the range of from about 0.01 to about 90 minutes. The optimum contact time of course will vary somewhat according to the particle size of the oil shale to be contacted, with larger particle sizes requiring longer contact time to be thoroughly penetrated by heat and water vapor.

After the shale has remained in the retort (10) for sufficient time to remove hydrocarbon and oil products therefrom it is removed from the retort (10) by line (18) and is transported to the recycle preheat (19). The off gas is removed from the retort where line (17) feeds the off gas into contact with retorted shale in the recycle preheat (19). Here the off gas removes heat from the retorted shale and cools it to a temperature of from about 500° C. to about 60° C. The off gas is then led from the recycle preheat (19) via line (21) into the auxiliary heater (20) where it is heated to a temperature of from about 500° to 575° C. From the auxiliary heater (20), the off gas is combined with superheated water vapor from line (13) and is mixed therewith into line (14) and forms a recycle gas having a temperature of about 500°–575° C. This recycle gas is injected back into the retort to maintain the retort temperature of about 500° C.

Shale oil is removed from the retort via line (15) for further processing. Sensible heat is removed from the retorted shale in the recycle preheat (19). Sensible heat as used herein refers to heat gained by the oil shale. Upon removing the heat from the oil shale, the temperature thereof is reduced from about 500° C. to about 60° C. From the recycle preheat (19) the retorted shale is fed into the crusher (23) through line (22). The crusher (23) can be either an autogenic or semi-autogenic type. An autogenic crusher is one in which the retorted shale particles are impacted upon one another by the use of opposing fluid jet streams to cause a further reduction in the size of the retorted shale particles. Fluids used for the jet streams generally include steam and inert gases such as compressed carbon dioxide or nitrogen. A jet mill is an example of an autogenic crusher. A semiautogenic crusher utilizes steel balls or other hardened devices to contact the retorted shale to cause a further fracturing of the retorted shale with an attendant reduction in the particle size of the retorted shale. Although steel balls are used in one embodiment, it is apparent that placing the retorted shale between any two moving surfaces sufficiently harder than said shale will have a crushing effect.

After the retorted shale has been reduced to the desired particle size, the crushed shale is removed from the crusher via line (24) where the coke, along with the inorganic matrix, is fed into a separator (25) suitable for use in the process of this invention. An exemplary separator suitable for use in this invention is a froth flotation process in which the coke and inorganic matrix materials are separated from one another by the use of chemicals. Separation occurs in the froth flotation process because of a difference in the specific gravity of the mixture.

Upon separation, the inorganic matrix material is removed via line (26) for further processing. Line (27) is used to remove the inorganic-free coke from the separator (25) where it is fed into a dryer (28) which removes the moisture from the coke. In order to effectively dry the coke, the dryer (28) is maintained at a temperature sufficient to dry the coke which is generally from about 100° C. to about 110° C. Once the coke has been dried, it is removed from the dryer (28) through line (29) where it is subjected to thermal treatment at a temperature sufficient to convert the coke to other energy forms which is generally from about 500° C. to 1000° C.

In a preferred embodiment, a steam gasifier (33) is used to produce synthesis gas. To maintain this temperature, superheated water vapor with a temperature of about 500° C. to 1000° C. is inducted into the steam gasifier (33) by line (32) and contacted with the coke. After contact with the coke, the synthesis gas comprises carbon monoxide and hydrogen. Line (34) is used to remove the resultant synthesis gas from the steam gasifier. After removal, the synthesis gas is used to further heat the auxiliary heater (20) as required. Ash is removed from the steam gasifier by line (31). The resultant ash can be formed into a grout or used as a Portland cement base, or as is preferred, it can be combined with the inorganic matrix material from line (26). Combining the inorganic matrix with the ash in this manner provides an efficient way to dispose of both the ash and inorganics to avoid unnecessarily contaminating the environment.

In another embodiment of the invention, thermal treatment is accomplished by use of a fluidized bed combustor. In this embodiment, air from line (32) is contacted with the inorganic free coke at a pressure of about 1 to 150 psig. When in contact with the coke, the process temperature in the fluidized bed combustor is generally maintained at a temperature of from about 500° to 1000° C. From the reactions ensuing, heated product gas is produced which comprises carbon dioxide and nitrogen. This gas can be utilized in the auxiliary heater (20) for additional heat as required to maintain the recycle gas temperature at about 500° C.

Although the present invention has been described with a certain degree of particularity, it is understood that the present disclosure has been made by way of example and that changes in detail of structure may be made without departing from the spirit thereof as set forth in the following claims.

What is claimed is:

1. A process for the recovery of hydrocarbon products and energy from oil shale, including separation of coke from shale, comprising:

(a) feeding raw shale into a surface retort;

(b) retorting the raw shale in the retort to recover hydrocarbon products and produce coke on the inorganic matrix;

(c) removing the retorted shale from the retort;

(d) recovering sensible heat from the retorted shale;

(e) crushing the retorted shale to a size sufficient so that the coke and inorganic matrix may be separated;

(f) separating the crushed, retorted shale into a coke fraction and an inorganic matrix fraction;

(g) contacting the coke fraction with either superheated steam or air in order to form carbonaceous product gases at a temperature of 500° to 1000° C.; and (h) recovering process heat from said product gases.

2. A process as in claim 1 in which the surface retort is maintained at a retorting temperature by injection of heated gas into the retort and step (d) is conducted by contacting the retorted shale with off gas from the retort and recycling the heated off gas back into the retort.

3. A process as in claim 1 in which step (e) is conducted by crushing the retorted shale by the use of fluid streams from at least two opposing jets.

4. A process as in claim 3 where the fluid streams from at least two opposing jets comprise an inert gas.

5. A process as in claim 3 where the fluid streams from at least two opposing jets comprise steam.

6. A process as in claim 3 where the fluid streams from at least two opposing jets comprise carbon dioxide.

7. A process as in claim 3 where the fluid streams from at least two opposing jets comprise nitrogen.

8. A process as in claim 1 in which step (e) is carried out by crushing the retorted shale by contacting it between at least two moving surfaces sufficiently harder than the coke.

9. A process as in claim 8 where the two moving surfaces are steel balls.

10. A process as in claim 1 in which step (f) is conducted by mixing flocculating chemicals with the inorganic matrix and separating the matrix from the coke.

11. A process as in claim 1 in which step (g) is carried out by injecting superheated water vapor in the presence of the heated coke and generating a heated carbon monoxide and hydrogen gas mixture.

12. A process as in claim 1 in which step (g) is conducted by heating the coke to a temperature of from about 100° to 110° C. after separating from the inorganic matrix and subsequently injecting air at a pressure of about 1 to 150 psig while heating the coke further to a temperature of from about 500° to 1000° C. to generate a heated carbon dioxide and nitrogen gas mixture.

13. In a process for retorting oil shale wherein coke-containing retorted shale is either combusted to provide process heat or used to produce synthesis gas, the improvement comprising:

(a) crushing the coke-containing retorted shale into a size sufficient so that the coke and inorganic matrix can be separated;

(b) separating the coke from the inorganic matrix;

(c) converting the coke into product gases comprising combustion gases and/or synthesis gases; and (d) recovering heat from said product gases.

14. A process as in claim 13 in which step (a) is conducted by crushing the retorted shale by use of fluid streams from at least two opposing jets.

15. A process as in claim 14 where the fluid streams from at least two opposing jets comprise steam.

16. A process as in claim 13 in which step (a) is performed by crushing the retorted shale by contacting it between at least two moving surfaces sufficiently harder than the coke.

17. A process as in claim 13 where in step (a) the retorted shale is crushed by at least two moving steel balls.

18. A process as in claim 13 where in step (a) the retorted shale is crushed by fluid streams from at least two opposing jets which streams comprise carbon dioxide.

19. A process as in claim 13 where in step (a) the retorted shale is crushed by fluid streams from at least two opposing jets which streams comprise nitrogen.

* * * * *